US007134583B2

(12) United States Patent
May et al.

(10) Patent No.: US 7,134,583 B2
(45) Date of Patent: Nov. 14, 2006

(54) STORAGE AND DISPENSING APPARATUS

(76) Inventors: David L. May, 21500 Thornhill Pl., Ashburn, VA (US) 20148; Kirstin S. May, 21500 Thornhill Pl., Ashburn, VA (US) 20148

( * ) Notice: Subject to any disclaimer, the term of this patent is extended or adjusted under 35 U.S.C. 154(b) by 56 days.

(21) Appl. No.: 10/831,951

(22) Filed: Apr. 26, 2004

(65) Prior Publication Data

US 2005/0150924 A1 Jul. 14, 2005

Related U.S. Application Data

(60) Provisional application No. 60/465,000, filed on Apr. 25, 2003.

(51) Int. Cl.
*B26F 3/00* (2006.01)

(52) U.S. Cl. ..... 225/97; 225/34; 225/46

(58) Field of Classification Search ..... 225/97, 225/93, 39, 46, 34; 206/575, 225
See application file for complete search history.

(56) References Cited

U.S. PATENT DOCUMENTS

| | | | | |
|---|---|---|---|---|
| 2,361,730 | A * | 10/1944 | Avrick | 206/225 |
| 3,042,278 | A * | 7/1962 | McCullough | 225/39 |
| 4,369,929 | A * | 1/1983 | Cayer | 242/423.1 |
| 5,301,854 | A * | 4/1994 | Scobey | 225/34 |
| 5,305,937 | A * | 4/1994 | Barnett | 242/594.6 |
| 6,123,197 | A * | 9/2000 | Marquez et al. | 206/575 |
| 6,616,087 | B1 * | 9/2003 | Chern | 242/559.2 |
| 2001/0040111 | A1 | 11/2001 | Spradlin et al. | |

* cited by examiner

*Primary Examiner*—Charles Goodman

(57) ABSTRACT

The present invention is directed to an improved gift wrap storage and dispensing device, comprising a container and a lid, which are rotatable with respect to one another. Wrapping paper is stored on dowels within the container and is dispensed through openings in the side wall of the container. The wrapping paper is cut using a cutting device positioned on the outside wall of the container. Similarly, the lid contains a dispensing housing for storing rolls of tape, ribbon, etc., which can be dispensed through openings in the side wall of the lid and cut using a cutting device.

16 Claims, 6 Drawing Sheets

FIG. 6
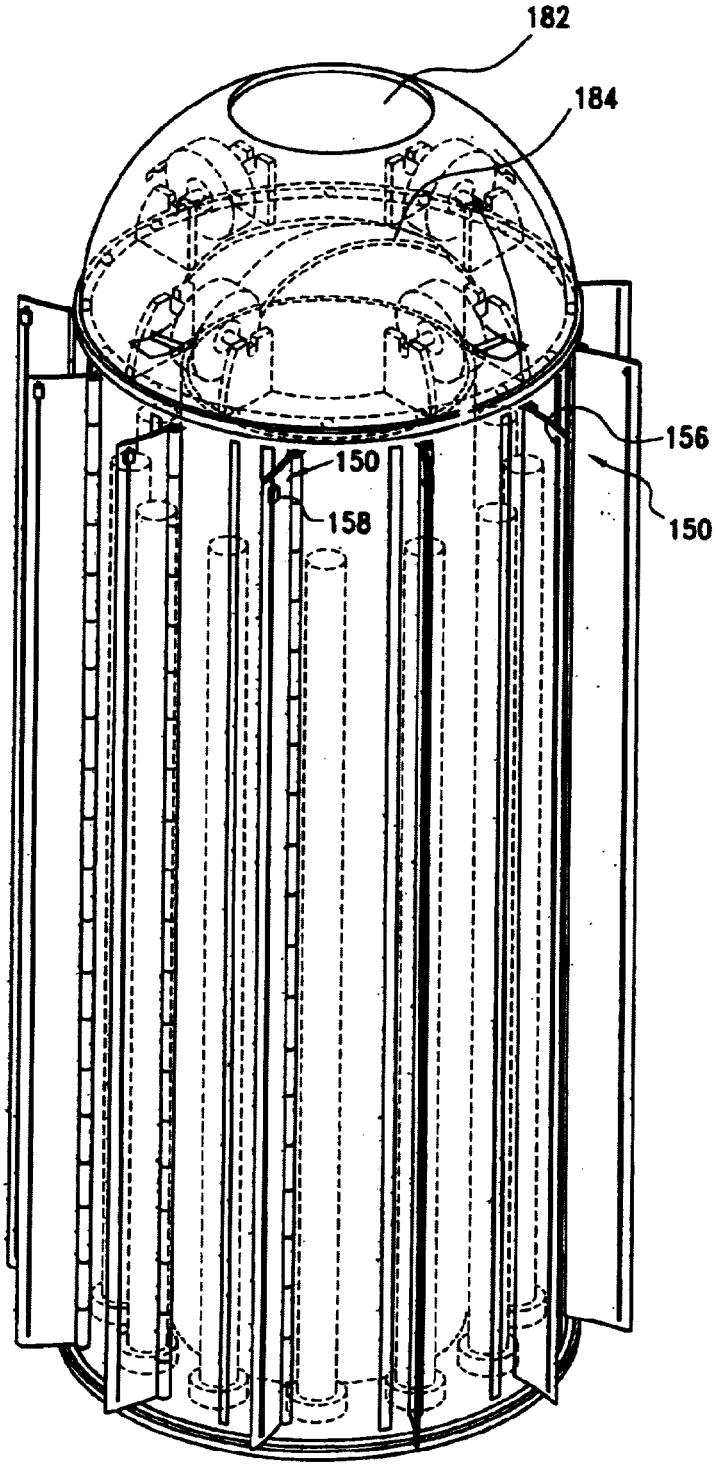
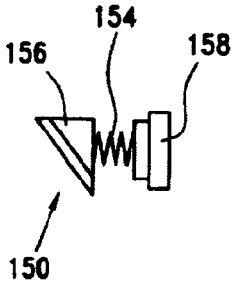
FIG. 6A

STORAGE AND DISPENSING APPARATUS

RELATED APPLICATION DATA

This application claims priority to U.S. Provisional Patent No. 60/465,000 filed Apr. 25, 2003, which is herein incorporated by reference in its entirety.

BACKGROUND OF THE INVENTION

1. Field of the Invention

This invention relates generally to field of gift wrap systems and storage devices.

2. Description of Related Art

Gift wrapping is a notoriously burdensome, messy, and disfavored chore, primarily because very little advancement has been made in the field of gift wrap storage and dispensing devices. During the holiday season, for example, it is common to use multiple rolls of wrapping paper, bows, ribbons of varying prints and designs. Further, there are typically numerous packages to be wrapped at a given time. A large working area is, therefore, required in order to work efficiently and effectively. In most instances, an open floor space is the only area large enough to accommodate the gift wrapping projects of ordinary scale. The traditional approach to wrapping gifts, therefore, entails sitting on the floor amongst what, before long, becomes a cluttered and disorganized mess of partially unraveled paper, accessories and trash. The inconvenience and awkwardness of having to bend, stretch, reach, and crawl across the floor to access wrapping paper and accessories inevitably leads to frustration and tiredness. Moreover, as almost anyone familiar with this situation knows, it is almost certain that scissors and tapes will be misplaced or buried among the scattered mess, thereby posing a serious risk of injury.

BRIEF DESCRIPTION OF THE DRAWINGS

FIG. 6 is a perspective view of the gift wrap apparatus;

FIG. 6A is a perspective view of the blade unit;

SUMMARY OF THE INVENTION

Figure 1:
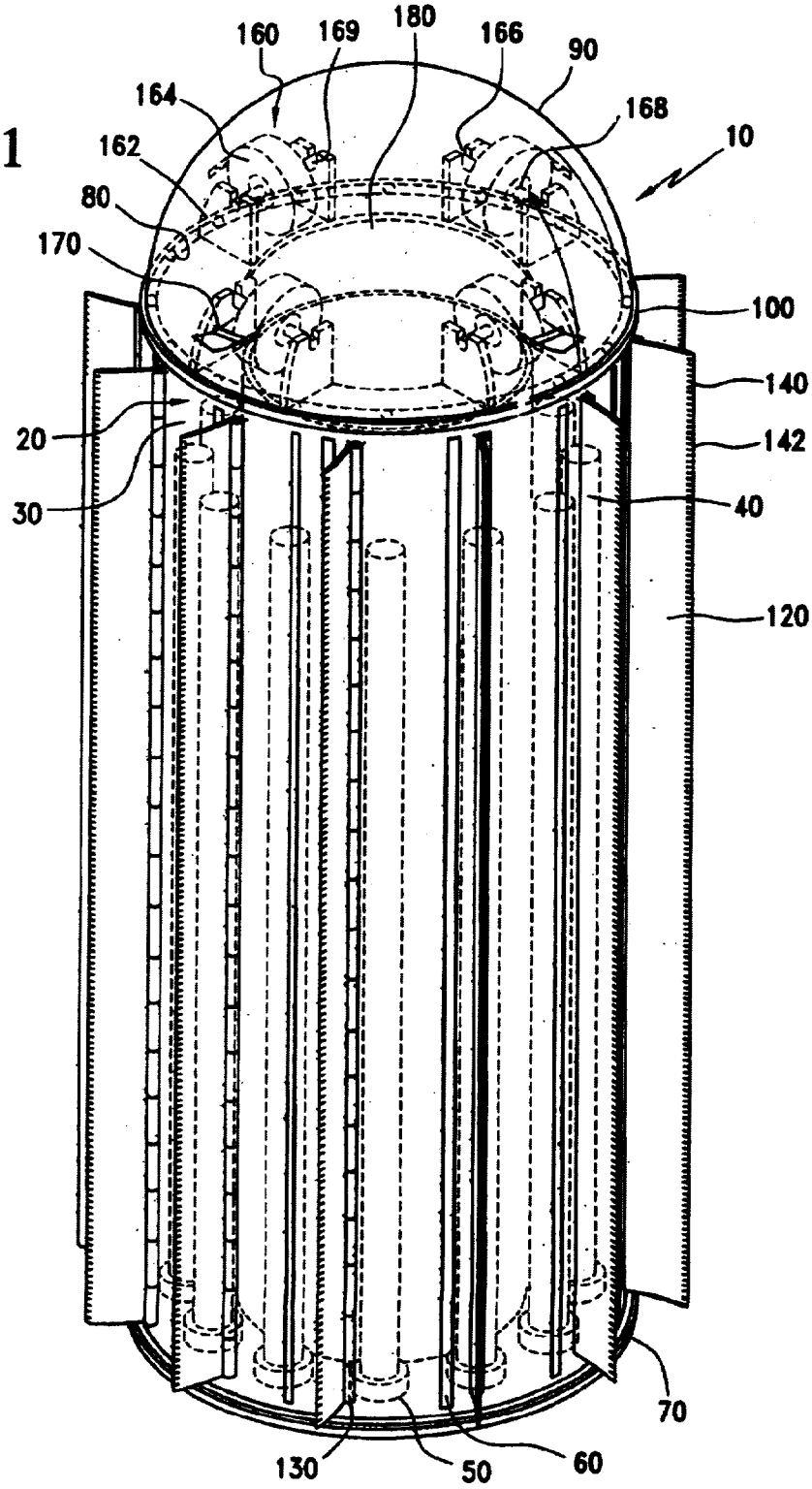
FIG. 1 is a perspective view of the gift wrap apparatus.
Figure 2:
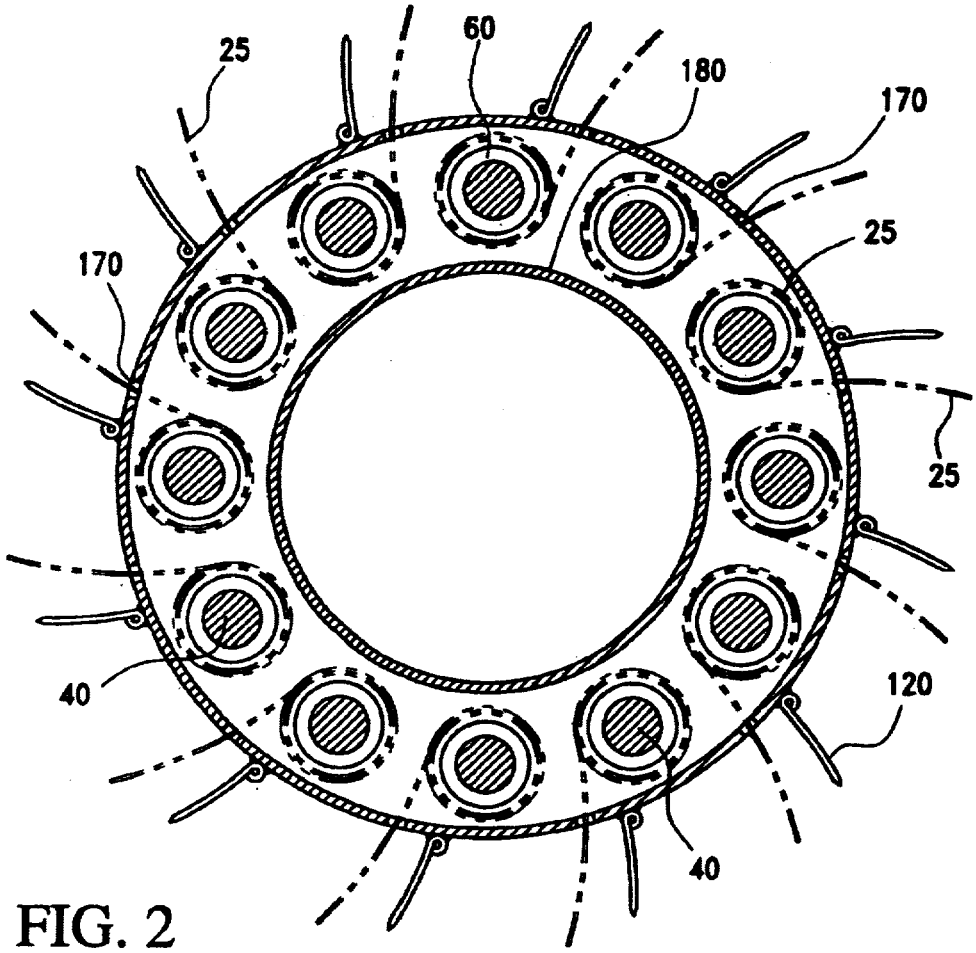
FIG. 2 is a 2 is a top view of the container of the gift wrap apparatus.
Figure 3:
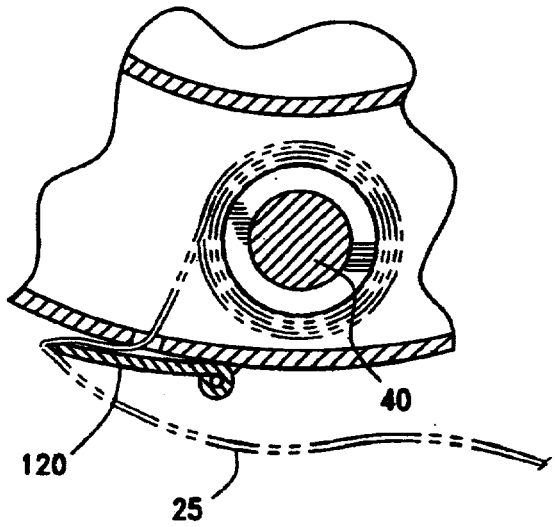
FIG. 3 is a cut-away top view of the container of the gift wrap apparatus.
Figure 4:
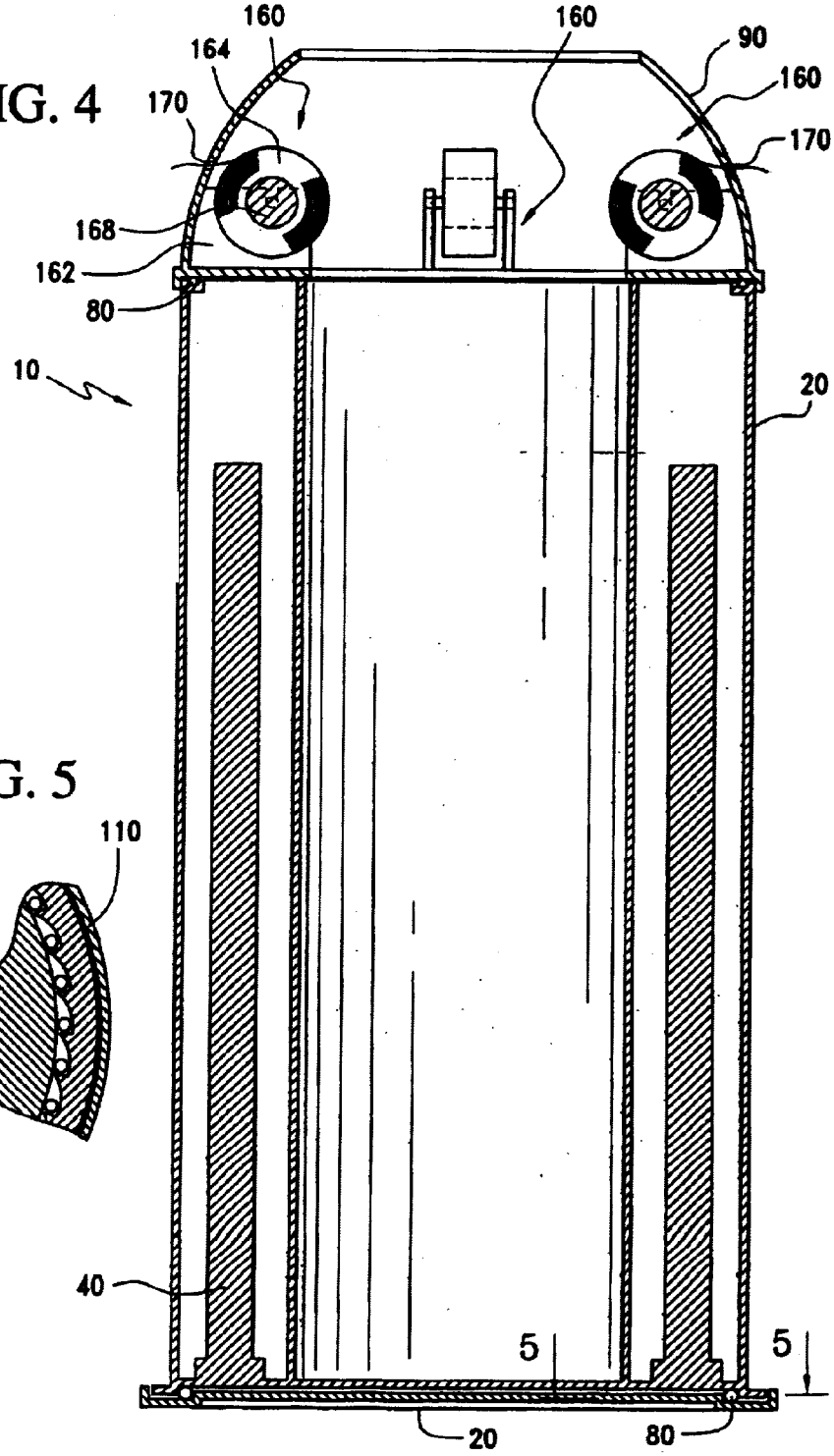
FIG. 4 is a cross section of the gift wrap apparatus.
Figure 5:
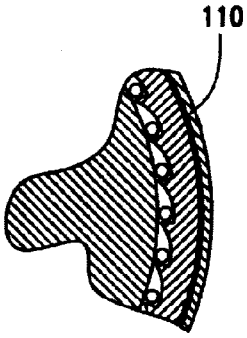
FIG. 5 is a cut-away view of the ratchet-system.
Figure 7:
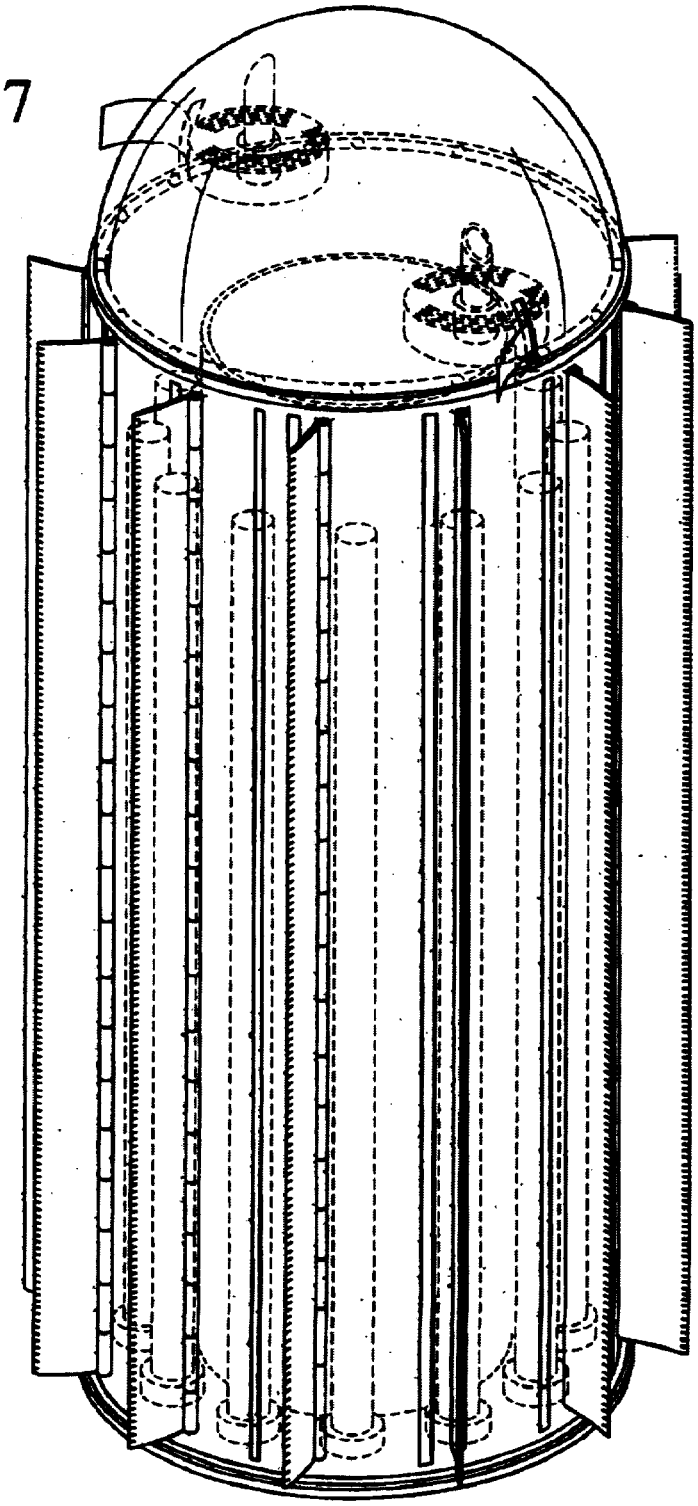
FIG. 7 is a second perspective view of the gift wrap apparatus.
Figure 8:
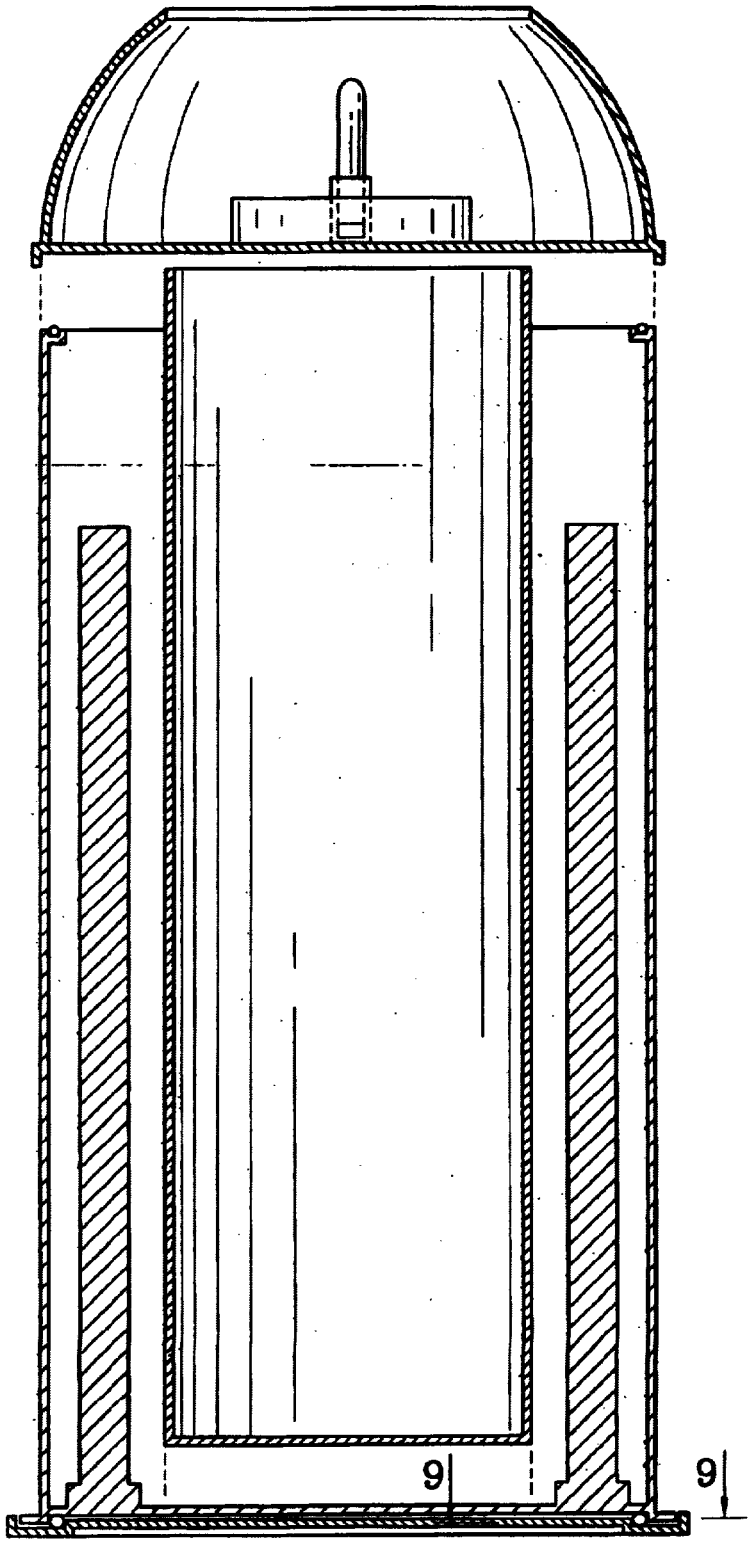
FIG. 8 is a third perspective view of the gift wrap apparatus.
Figure 9:
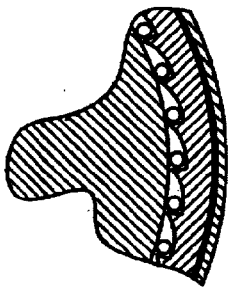
FIG. 9 is cut-away view of the ratchet-system.

The present invention provides, in a preferred embodiment, an improved gift wrap system and storage device, wherein wrapping paper and wrapping accessories are accessible for use from their stored position in the apparatus. The apparatus comprises a container which houses a plurality of dowels for holding rolls of wrapping paper. The wrapping paper is dispensed through openings in the container adjacent to the dowels. Once the desired amount of wrapping paper is dispensed, flaps positioned on the sides of the container fold down against wrapping paper to hold it firmly against the side of the container, and to keep excess wrapping paper from being dispensed once the desired amount of wrapping paper for a particular gift has been dispensed. A cutting device, such as a serrated edge or the like, is positioned on the flap. Wrapping paper extending beyond the flap on the container is grasped and pulled against the cutting device to cut the paper to the desired length. The container is preferably rotatably affixed to a base so that the user can, while remaining in one position, rotate the container so that the desired wrapping paper inside container is easily accessible.

The apparatus includes a lid, which is rotatably positioned on a flange extending perpendicularly from the container, and a dispenser housing extending from the inside wall of the lid. Removable dispenser wheels are provided which are designed to be inserted into the center of rolls of ribbon or tape. The dispenser wheels have pegs extending perpendicularly from both sides, which are dimensioned to fit into corresponding recesses in the dispenser housing. Lid 9 has openings in its side wall through which wrapping accessories, e.g. tape and ribbon, are dispensed. A cutting device, such as a serrated edge or the like, is positioned at each opening for cutting the wrapping accessories. Lid 9 preferably has an opening at its top end, which may be covered by a door.

Rotation of the container and the lid is facilitated by, for example ball bearings positioned between the flange and the lid. Locking mechanisms, such as a levers which, when engaged, apply frictional force to the container or base, or a ratchet-like system, are used to prevent container from rotating when directional force is applied to the container, such as when dispensing or cutting the wrapping paper.

In another embodiment apparatus includes an second, inner-container, which is positioned inside the outside container and the dowels. The inner container can be used as a trash receptacle or for storing additional rolls of wrapping paper. The top side of the inner container is open to the opening in the lid, such that trash or wrapping paper can be inserted in the inner container through the opening in the lid, without having to remove the lid.

DETAILED DESCRIPTION OF THE INVENTION

The present invention provides an improved gift wrap apparatus designed to eliminate the inadequacies of conventional gift wrap and storage devices. In particular, the invention is directed to a gift wrap apparatus that conveniently stores multiple rolls of wrapping paper and wrapping accessories while, at the same time, making the wrapping paper accessible without having to remove the wrapping paper or accessories from the apparatus. The apparatus, therefore, greatly simplifies the process of wrapping gifts, and eliminates many of the inconveniences and attendant dangers of traditional wrapping apparatus and techniques.

In a preferred embodiment, as exemplified in FIG. 1, the present invention provides a gift wrap apparatus 10 comprising a container 20 having at least one side wall 30, and at least one dowel 40 extending from the floor 50 of container 20 for receiving rolls of wrapping paper 25. Side wall 30 has at least one opening 60 or slits through which wrapping paper is dispensed. Openings 60, therefore, are preferably positioned proximate to dowels 40. Container 2 is rotatably situated on a base 70, the rotation being facilitated, for example, by ball bearings 80 or other known rotating means. Container 20 includes a removable lid 90, which in a preferred embodiment is itself rotatably situated among an annular flange 100 extending perpendicularly from side wall 30. The rotation of lid 90 is also being facilitated by, for example, ball bearings 80 or other known rotation means. Container 20 and lid 90 are, therefore, separately rotatable with respect to one another. At least one first locking mechanism (not shown) is positioned on base 7 and at least one second locking mechanism (not shown) is positioned on container 20. The first locking mechanism, for example, can be a lever disposed on base 70, which when frictionally engaged with container 20, prevents rotation of container 20 with respect to base 70. Similarly, the second locking mechanism can be a lever positioned on the upper portion of side wall 30, which when frictionally engaged with lid 90, prevents rotation of lid 90 with respect to container 20. In another embodiment, the first locking mechanism and second locking mechanism can comprise a standard ratchet-like system 110, which permits rotation in one direction, but prevents rotation in an opposite direction. In essence, any known locking mechanism which prevents rotation of container 20 or lid 90 can be used.

On the exterior of container 20, adjacent to each opening 60 is a flap 120 coupled to container 20, by for example, a hinge mechanism 130, for securing wrapping paper dispensed through opening 60 to the exterior of side wall 30 of container 20. A cutting device 140, e.g. a serrated edge, is positioned on flap 120. In one embodiment cutting device 140 is positioned on the outside edge 142 of flap 120. In another embodiment, cutting device 140 is a blade unit 150 coupled to the outside face of flap 120 and, in accordance with this embodiment, has a vertically positioned opening 152 which serves as a track for blade unit 150. Blade unit 150 is spring 154-loaded and comprises a blade 156 coupled to a press tab 158. Press tab 158 is positioned on the outside face of flap 120, with the blade 156 projecting into opening 152. In a relaxed position, press tab 158 rests above flap 120, such that blade 156 extends only partially through opening 152. When flap 120 is closed upon wrapping paper 25, pressure is applied to press tab 158 such that blade 156 extends fully through opening to cut wrapping paper 25. While maintaining pressure on press tab 158, blade unit 156 is then pushed downward along opening 152, to cut wrapping paper 25 from its top edge to its bottom edge.

With flaps 120 open, wrapping paper 25 is dispensed through openings 60 in side wall 30 of container 20, until the desired length of wrapping paper 25 has been dispensed. Flaps 120 are then folded downward to tightly secure wrapping paper 25 against side wall 30 of container 20. Wrapping paper 25 extending beyond outside of flap 120 is grasped and pulled against cutting device 140 on flap 120, so as to cut wrapping paper 25 to the desired length. A lead portion of wrapping paper 25, having an approximate width of flap 120, will remain under flap 120. The downward force applied to wrapping paper 25 by flap 120, or the resistance applied by the aforementioned ratchet system 110, which is applied in the direction opposite to that in which wrapping paper 25 is pulled against cutting device 140, prevents excess wrapping paper 25 from being dispensed. When flap 120 is opened, the lead portion of wrapping paper 120 will be exposed, which will serve as the grasping portion for the next section of wrapping paper 25 to be dispensed. Flap 120, therefore, always maintains portion of wrapping paper 25 outside of container 10, so that wrapping paper 25 does not have to be fed through openings 60 each time a new piece of wrapping paper 25 is cut. Wrapping paper 25 does not have to be removed from its stored position on the dowels 40 in container 10 prior to use. When a roll of wrapping paper 25 is depleted, the cardboard sleeve upon which wrapping paper 25 is wound is simply removed from dowel 40 and discarded. A new roll of wrapping paper 25 is placed on dowel 40 in its place. The number of rolls of wrapping paper 25 available for dispensing at any one time is determined by the number of dowels 40 in container 20. Dowels 40 are preferably of a diameter smaller than the diameter of the sleeve upon which wrapping paper 25 is wound, so that wrapping paper 25 rolls can be easily placed on and removed from dowel 40. Dowels 40 can be of any length, but where there is a lid 90, preferably not so long as to hinder the placement of lid 90 onto container 20. It is contemplated that wrapping paper 25 of different styles and different prints, for example, will be placed on the various dowels 40, so as to offer and provide access to a wide variety of wrapping paper 25.

Lid 90 preferably contains an accessory dispenser 160 for holding, storing, and dispensing gift wrap accessories 164, such as ribbon and tape, extending from the interior of lid 90. In a preferred embodiment, dispenser 160, comprising a housing unit 162 having recesses 166 for receiving a dispensing wheel 168. Dispensing wheel 168 is positioned within the open center portion of a roll of tape or ribbon and has a tight tolerance with respect thereto, such that frictional force maintains dispensing wheel 168 within the open center portion of the roll of tap or ribbon. Extending laterally from dispensing wheel 168 are pegs 169, dimensioned to fit and be secured within recesses 166 of housing unit 160. Lid 90 has openings 170 or slits therein through which gift wrapping accessories 164, e.g., positioned within housing unit 160 can be dispensed. A cutting device (not shown), e.g. a serrated edge, razor blade, etc. is positioned on the lid 90 at the position of opening 170 for cutting the accessory 164 dispensed through said opening 170.

Apparatus 10 is particularly advantageous in that its user or users, from a single position, has access to multiple rolls of wrapping paper 25 which, in ordinary instances, will vary in style and design. Apparatus 10 is, therefore, a significant improvement over conventional gift wrap apparatus, in that apparatus 10 serves simultaneously as a storage device, and a gift wrap and accessory dispenser. Moreover, unlike the conventional methods of gift wrapping, for example, wherein one sits on the floor amidst wrapping paper strewn about, apparatus 10, eliminates the inherent discomforts (e.g. backaches), dangers (e.g. cuts and/or strained muscles), frustrations (e.g. lost scissors) and clutter attendant with these conventional methods. For instance, apparatus 10 can be conveniently situated next to its user, whether on the floor and adjacent to a table top, for example, leaving ample working space for gift wrapping. Container 20 is rotated to position the wrapping paper 25 of interest adjacent to its user. The user then simply dispenses the desired amount of wrapping paper 25 and cuts it using cutting device 140. When user wants to use a different style or type of wrapping paper 25, without having to reach or reposition, user simply rotates container 20, so that the desired roll of wrapping paper 25 is positioned adjacent to the user. Similarly, lid 90 is rotated, so that the desired gift wrapping accessory 164 is positioned adjacent to user. Accessory 164 is dispensed through opening 170 and cut at the desired length using cutting device. Since lid 90 and container 20 are separately rotatable with respect to each other, user can have any combination of wrapping paper 25 and accessory 164 positioned immediately adjacent user. Where, for example, user wishes to use a different wrapping paper 25, but continue using a particular accessory 164, user can disengage the first locking mechanism (not shown) and freely rotate container 20 until the next desired wrapping paper 25 is positioned adjacent user. Likewise, where user wishes to use a different accessory 164, but wants to continue using a particular wrapping paper 25, user can disengage second locking mechanism (not shown) and freely rotate lid 90, until the next desired accessory 164 is positioned adjacent user. It is further contemplated that container 20 can be positioned on its side, such that wrapping paper 25 is dispensed parallel to surface upon which a gift is wrapped. With container 20 on its side, a predetermined amount of wrapping paper 25 can be dispensed, and a gift placed on the paper to determine exactly how much wrapping paper 25 is necessary to wrap the gift. Once the desired length of wrapping paper 25 is determined, wrapping paper 25 can be cut using cutting device 140.

In another preferred embodiment, a second, inner container 180 is housed within container 20 and lid 90 has an opening 182 positioned on its topside. Dowels 40 are preferably positioned between inner container 180 and container 20. Inner container 180 preferably has a handle 184 to facilitate its removal from container 20. It is contemplated that inner container 180 can be used to store additional rolls of wrapping paper 25 which are not positioned on dowels 40, or used as a trash receptacle for receiving paper scraps, etc. Opening 182 in lid 90 is preferably positioned in-line with opening of inner container 180, such that rolls of wrapping paper, trash, etc. can be placed into inner container 180 without having to remove lid 90. When used as a trash receptacle, for example, inner container 180 can be removed from container 20, emptied, and reinserted into container 20.

What is claimed is:

1. A storage and dispensing apparatus comprising:

a first container, said container comprising an open end, a closed end, at least one side wall having at least one opening, and at least one dowel positioned within said container;

at least one cutting device on said container; and a lid, said lid comprising at least one dispenser, and at least one opening within at least one side of said lid.

2. The apparatus of claim 1, further comprising a base.

3. The apparatus of claim 1, further comprising a second container positioned within said first container.

4. The apparatus of claim 3, wherein said second container is removable from said first container.

5. The apparatus of claim 1, wherein a rotation device is positioned between said lid and said container.

6. The apparatus of claim 5, wherein said rotation device are ball bearings.

7. The apparatus of claim 1, wherein a rotation device is positioned between said base and said container.

8. The apparatus of claim 7, wherein said rotation device are ball bearings.

9. The apparatus of claim 1, wherein said first container is cylindrical, and further comprising a plurality of dowels positioned circumferentially within said container.

10. The apparatus of apparatus of claim 1, wherein said at least one dowel is removeable from said container.

11. The apparatus of claim 1, wherein said lid comprises an opening on its top-end.

12. The apparatus of claim 11, further comprising a second container positioned within said first container, and wherein the opening on said lid is aligned with the open end of said container, such that objects can be passed through said opening into said container.

13. The apparatus of claim 3, wherein said second container comprises a handle.

14. The apparatus of claim 1, further comprising a at least one flap attached to said container adjacent to each of at least one said openings, said flap being movable relative to said container to selectively cover and uncover said opening.

15. The apparatus of claim 14, wherein said flap comprises a cutting device.

16. The apparatus of claim 1, further comprising a cutting device on said lid.

* * * * *